US009896818B1

(12) United States Patent
Nitti et al.

(10) Patent No.: US 9,896,818 B1
(45) Date of Patent: Feb. 20, 2018

(54) TILT BUCKET RECESSED PIVOT DESIGN

(71) Applicant: Caterpillar Inc., Peoria, IL (US)

(72) Inventors: Julia Kay Nitti, Aurora, IL (US); Neil Racelis Bautista, Aurora, IL (US); David Worth, Naperville, IL (US); Giedre Simanskaite, Lisle, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/239,583

(22) Filed: Aug. 17, 2016

(51) Int. Cl.
*E02F 3/00* (2006.01)
*E02F 3/36* (2006.01)
*E02F 3/40* (2006.01)

(52) U.S. Cl.
CPC ..... *E02F 3/3677* (2013.01); *E02F 3/40* (2013.01)

(58) Field of Classification Search
CPC ..... F15B 15/068; E02F 3/3645; E02F 3/40; E02F 3/345; E02F 3/3677; E02F 3/96; E02F 3/364; E02F 3/3663; E02F 3/3681; E02F 3/3622; E02F 3/3627; E02F 9/2271
USPC ..... 37/468, 403, 443, 444; 414/705, 722, 414/723
See application file for complete search history.

(56) References Cited

U.S. PATENT DOCUMENTS

| | | | | |
|---|---|---|---|---|
| 4,906,161 | A * | 3/1990 | Weyer | E02F 3/345 37/403 |
| 5,145,313 | A * | 9/1992 | Weyer | E02F 3/3618 37/468 |
| 5,271,170 | A | 12/1993 | Mieger | |
| 6,000,154 | A | 12/1999 | Berard et al. | |
| 6,539,650 | B2 * | 4/2003 | Kaczmarski | E02F 3/3622 37/468 |
| 7,066,706 | B2 | 6/2006 | Risch et al. | |
| 8,544,562 | B2 * | 10/2013 | Weyer | E02F 3/3663 173/218 |
| 2010/0095720 | A1 | 4/2010 | Howarth | |
| 2015/0292551 | A1 | 10/2015 | Hoffmans et al. | |

* cited by examiner

*Primary Examiner* — Robert E Pezzuto
(74) *Attorney, Agent, or Firm* — Law Office of Kurt J. Fugman LLC

(57) ABSTRACT

A tilting bucket assembly comprises an adapter subassembly including a two coupler members defining a coupler distance, a base plate attached to the coupler members that defines a first recess, a torsion tube that defines a second recess, and a bucket subassembly that is pivotally connected to the adapter subassembly, the bucket subassembly including a spill guard including a stop portion configured to contact the adapter subassembly, and a tilting mechanism, wherein the first recess and second recess clear the tilting mechanism and the spill guard when the base plate contacts the stop portion of the spill guard.

20 Claims, 9 Drawing Sheets

TILT BUCKET RECESSED PIVOT DESIGN

TECHNICAL FIELD

The present disclosure relates to pivot designs for buckets that tilt. More particularly, the present disclosure is related to a recessed pivot design for buckets that tilt that allows for a spill guard to be used that lacks any notch for facilitating the bucket to tilt 45 degrees without impinging or pinching any hydraulic lines or cylinders, etc. that power the tilting of the bucket.

BACKGROUND

Tilting buckets are well known in the construction industry and the like for allowing an operator of a machine to properly grade sloped surfaces by tilting the bucket at the desired angle. In many bucket designs, the maximum angle accommodated by the pivot design for the bucket is approximately 45 degrees.

The coupling system used to connect the bucket to a machine may include hook members that are spaced apart a predetermined distance in a direction that is perpendicular to the pivot axis of the bucket. In such a case, if the hooks are too far apart and it is desirable to provide a 45 degree angle of tilting, it is often necessary to cut clearance notches such as v-shaped notches in the spill guard or similarly positioned structure of the bucket assembly to allow the 45 degree angle of tilt to be accomplished. However, dirt and debris may evade through the notch during use, such as when the full 45 degrees of tilt is not needed because the coupling or adapter subassembly of the bucket assembly is not in the notch. This happens to be the case for most excavating and grading operations. As a result, this area may become clogged with dirt or debris, which may interfere with the operation of the bucket assembly. Also, parts of the hydraulic system such as the hoses may become abraded, necessitating maintenance or replacement.

Looking at FIGS. 1 thru 3, a prior art tilting bucket assembly 100 may be seen that is used with a quick coupling mechanism known in the art. Hook members 102 are provided that define a predetermined distance D102 between them. The spill guard 104 and its backup plate 114 include V-shaped clearance notches 106 that allow the tilting of the bucket assembly 100 to be performed while also allowing dirt and debris to infiltrate near the workings of the tilting mechanism 108 including the hydraulic hoses 110 and hydraulic cylinders 112. Furthermore as best seen in FIG. 2, the pivot height PH, which is the distance from the base plate 116 to the pivot axis 118, cannot be reduced significantly due to the structural interference between the bucket subassembly 120 and the adapter subassembly 122 including the base plate 116 and hook members 102. Also, interference between the base plate 116, torsion tube 124 and the hydraulic cylinders 112 and hoses 110 would also present a problem should the pivot height PH be reduced. As also shown in FIG. 2, this also makes reducing the tip radius TR, which is measured from the hook center 128 (may also be described as the center of the aperture of the hook member) to the front working edge 126 of the bucket difficult. This may make the force necessary to move the tilting bucket assembly 100 of FIGS. 1 thru 3 through a work material such as soil greater than desirable due to the increased leverage exerted by the work material near the tip or front working edge 126 of the bucket.

It should be noted that typically dimensions like the tip radius TR and pivot height PH are measured with the bucket subassembly 120 and adapter subassembly 122 are in their purely horizontal and vertical positions. More specifically, the tilt angle is zero degrees such that the front working edge 126 and base plate 116 are horizontally oriented.

SUMMARY OF THE DISCLOSURE

A tilting bucket assembly is provided comprising an adapter subassembly including a pair of coupler members that define a coupler distance which is the minimum distance therebetween, a base plate attached to the coupler members and that defines a first recess, a torsion tube that defines a second recess that is in communication with the first recess, and a bucket subassembly that is pivotally connected to the adapter subassembly defining a pivot axis, the bucket subassembly including a spill guard lacking clearance notches for receiving the adapter subassembly, the spill guard including at least one stop portion that is configured to contact the adapter subassembly, and a tilting mechanism, wherein the adapter assembly defines a pivot height that is the minimum distance measured from the base plate to the pivot axis, and wherein a pivot clearance ratio of the coupler distance to the pivot height ranges from 3 to 6.

A tilting bucket assembly is provided comprising an adapter subassembly including a pair of coupler members that define a coupler distance, which is the minimum distance therebetween, a base plate attached to the coupler members and that defines a first recess, a torsion tube that defines a second recess that is in communication with the first recess, and a bucket subassembly that is pivotally connected to the adapter subassembly defining a pivot axis, the bucket subassembly including a spill guard including at least one stop portion that is configured to contact the adapter subassembly, and a tilting mechanism, wherein the first recess and second recess are configured to clear the tilting mechanism and the spill guard when the base plate contacts a stop portion of the spill guard.

A tilting bucket assembly is provided comprising an adapter subassembly including a pair of coupler members that define a coupler distance therebetween, a base plate attached to the couple members and that defines a first recess, a torsion tube that defines a second recess that is in communication with the first recess; and a bucket subassembly that is pivotally connected to the adapter subassembly defining a pivot axis, the bucket subassembly including a spill guard including at least one stop portion that is configured to contact the adapter subassembly, and a tilting mechanism, wherein the adapter assembly defines a pivot height that is the minimum distance measured from the base plate to the pivot axis and the torsion tube defines a perimeter in a plane defined by the pivot height and the pivot axis, the perimeter including a straight portion that is substantially parallel to the pivot height that leads to a straight segment that is parallel to the pivot axis that transitions to an angled portion that forms an included angle with the pivot axis.

DETAILED DESCRIPTION

Figure 1:
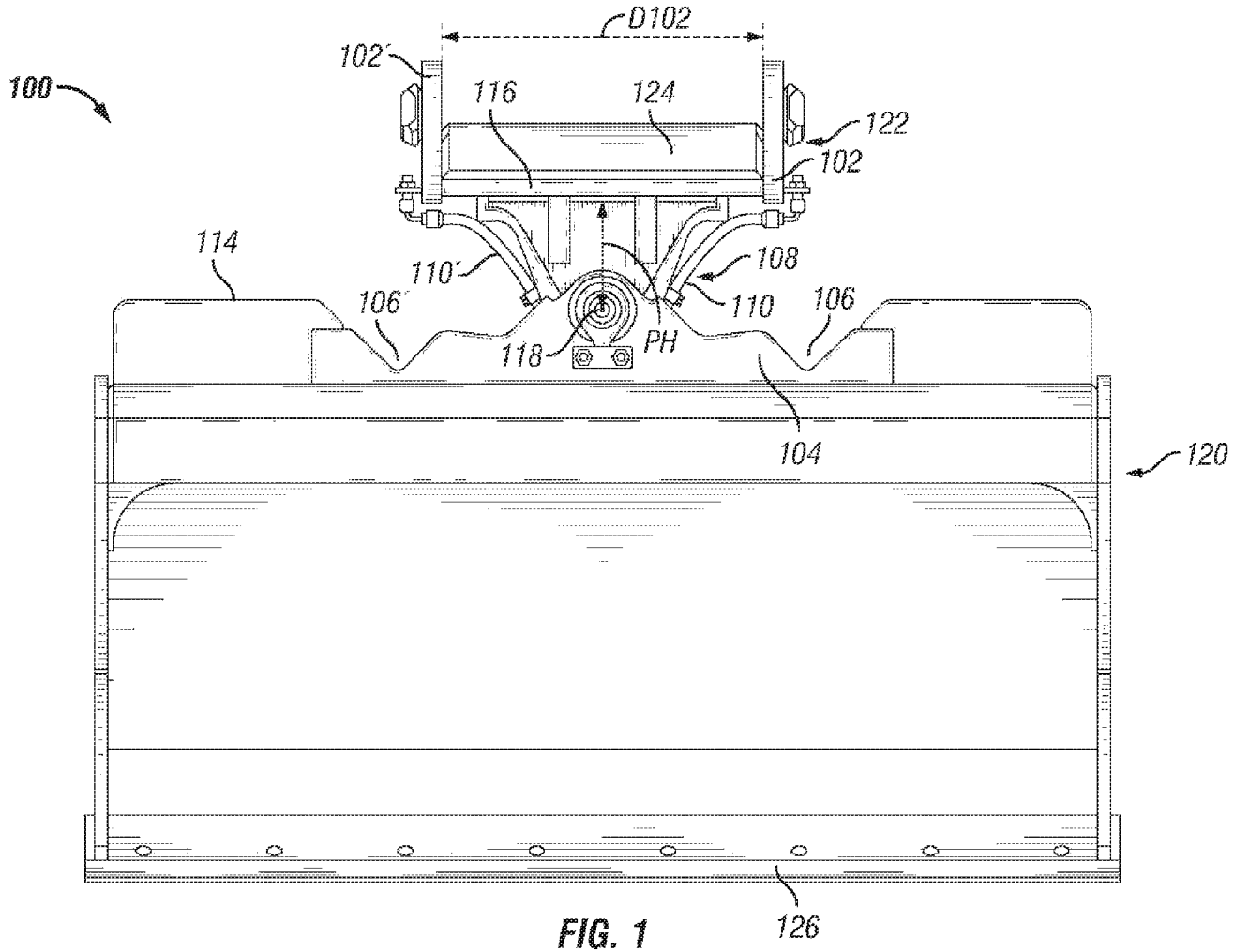
FIG. 1 (Prior Art)
FIG. 1 is a front view of a prior art tilting bucket assembly that includes V-shaped notches in its spill guard and backup plate, allowing the bucket assembly to pivot 45 degrees about its pivot axis.
Figure 2:
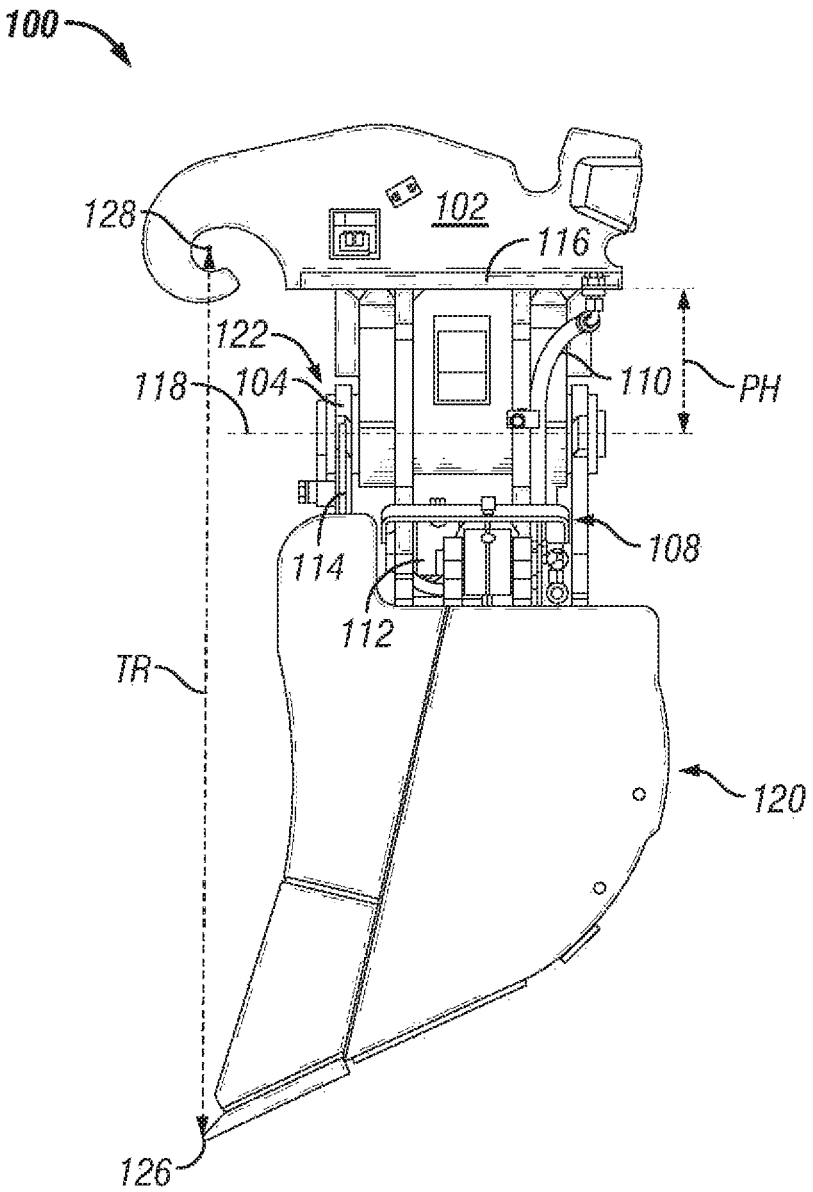
FIG. 2 (Prior Art)
FIG. 2 is a side view of the prior art tilting bucket of FIG. 1, depicting the pivot height from the bottom of the base plate to the pivot axis and the tip radius from the center of an aperture of the hook member to the front working edge of the bucket.
Figure 3:
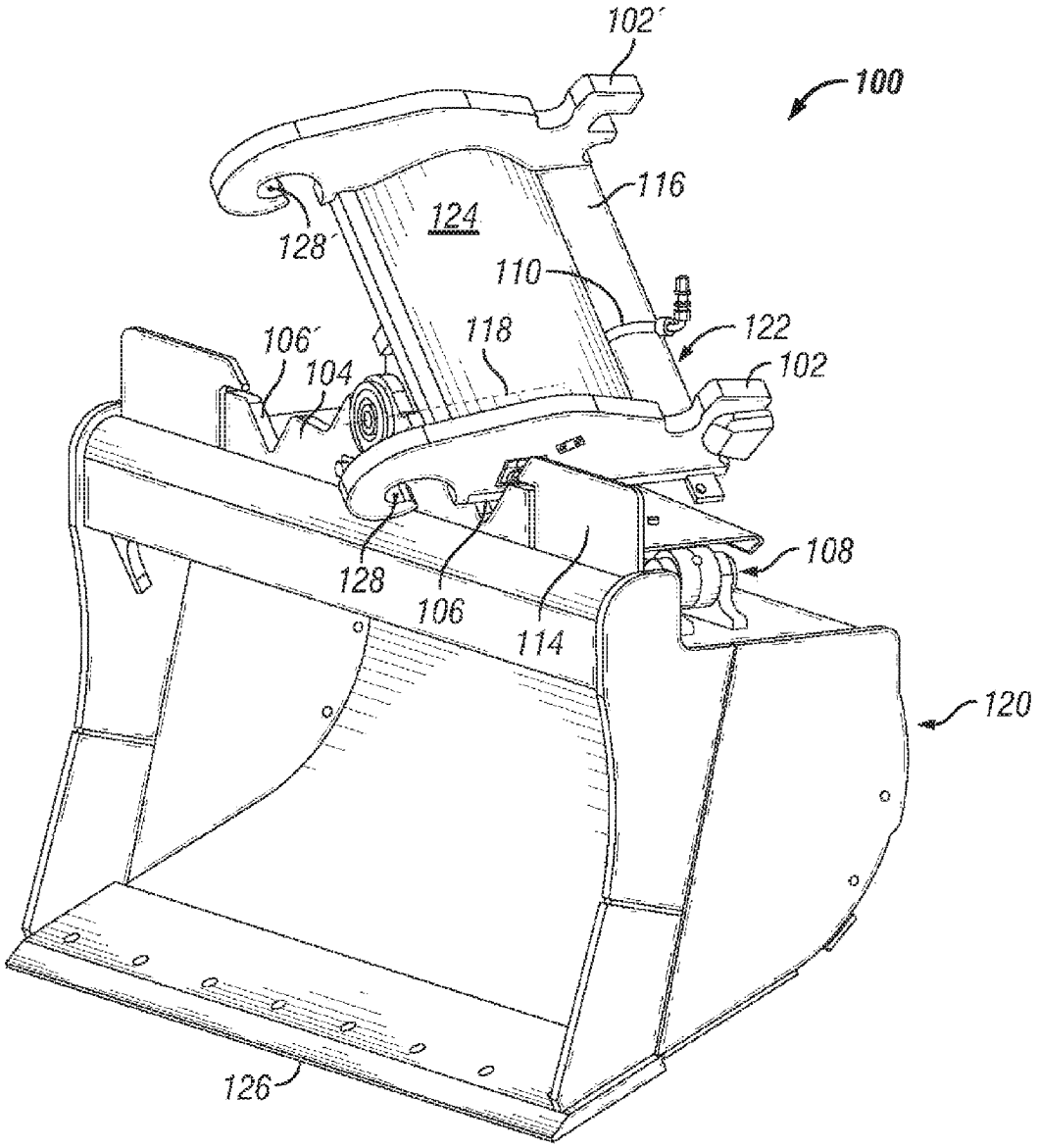
FIG. 3 (Prior Art)
FIG. 3 is a perspective view of the prior art tilting bucket of FIG. 1, showing the bucket tilted at a 45 degree angle such that the adapter subassembly is located in the V-shaped notch of the spill guard.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides various embodiments of tilting bucket assemblies that allow higher pivot clearance ratios and break out force optimization ratios to be provided than has been previously been provided. In some embodiments, an optimization of the recesses formed by the base plate and the torsion tube facilitate this improvement. In other embodiments, less dirt and debris may infiltrate the area near the tilting mechanism. This may be accomplished by providing a spill guard that lacks clearance notches for receiving the base plate as the assembly approaches a maximum tilt angle.

Looking at FIGS. 4-11, an embodiment of a tilting bucket assembly 200 with an improved pivot clearance ratio and a spill guard 204 that lacks clearance notches is illustrated. Focusing now on FIGS. 4 thru 6, a tilting bucket assembly 200 may comprise an adapter subassembly 222 including a pair of hook members 202 that define a hook distance D202, which is the minimum distance between the hook members 202, a base plate 216 attached to the hook members 202 that defines a first recess 230, and a torsion tube 224 that defines a second recess 232 that is in communication with the first recess 230 being positioned proximate the first recess 230.

The tilting bucket assembly 200 further comprises a bucket subassembly 220 that is pivotally connected to the adapter subassembly 222 defining a pivot axis 218. The pivot connection 206 includes a pin 234 that extends through a bushing member 236 that extends through bores defined by members 240 of the adapter subassembly 222 in a manner well known in the art. More specifically, at least two ear members 240 extend downwardly from the adapter subassembly 222 that define bores for receiving the bushing member 236 and the pin 234. A middle member 240" is also provided to allow the functioning of the tilt mechanism as will be described later herein. It should be noted that FIG. 6 has slight modifications when compared to FIGS. 4 and 5. These modifications include the fact that backup plate is omitted and only one middle member is shown that extends down from the adapter subassembly for providing both the pivot connection and means for attaching the hydraulic cylinder of the tilting mechanism. The adapter subassembly is so called as its function is to mate with or adapt the bucket assembly to the coupling mechanism (not shown) of the machine.

Figure 4:
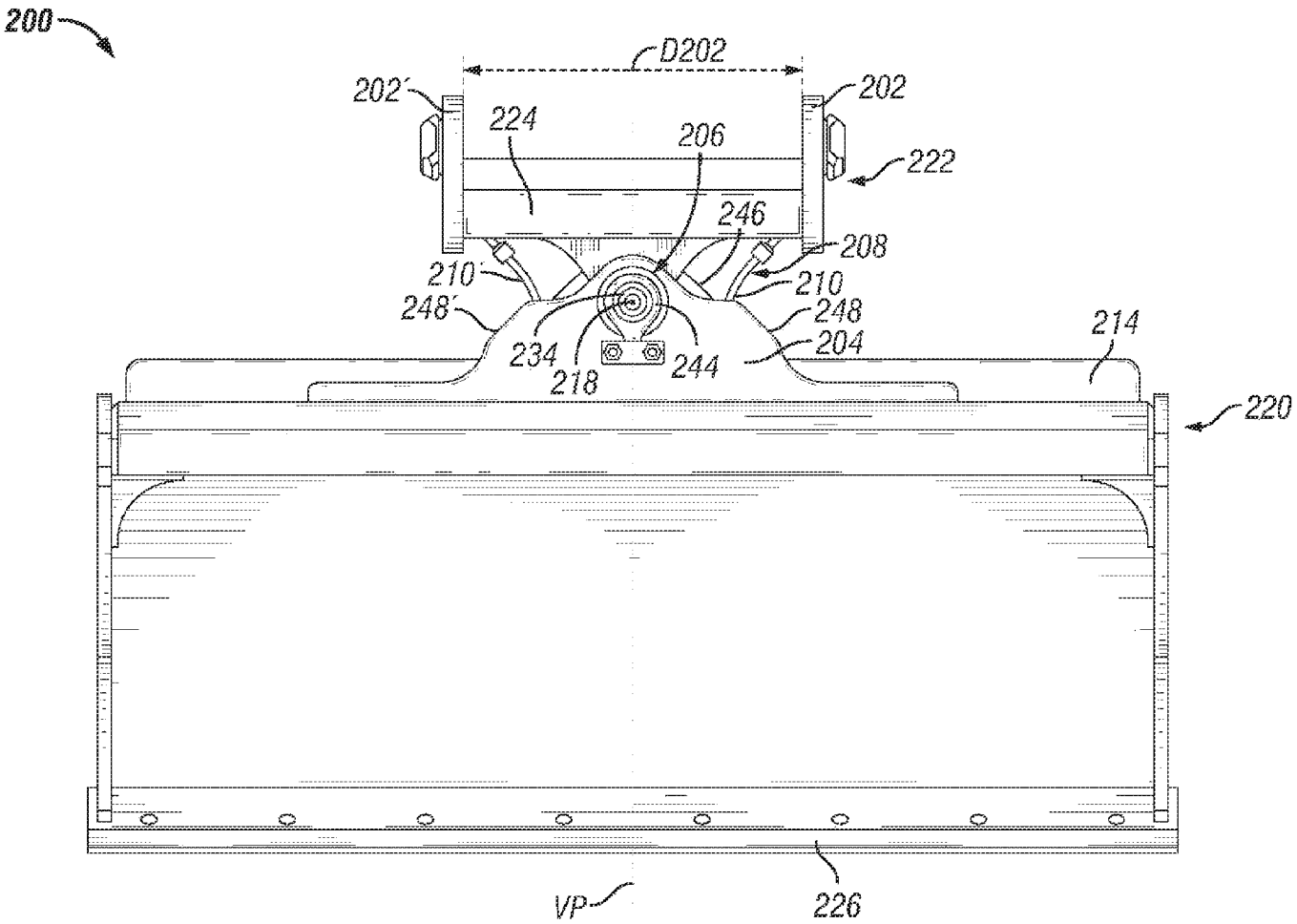
FIG. 4 is a front view of an embodiment of a tilting bucket assembly of the present disclosure that has a spill guard lacking any notches while still allowing the bucket to tilt at a 45 degree angle.
Figure 5:
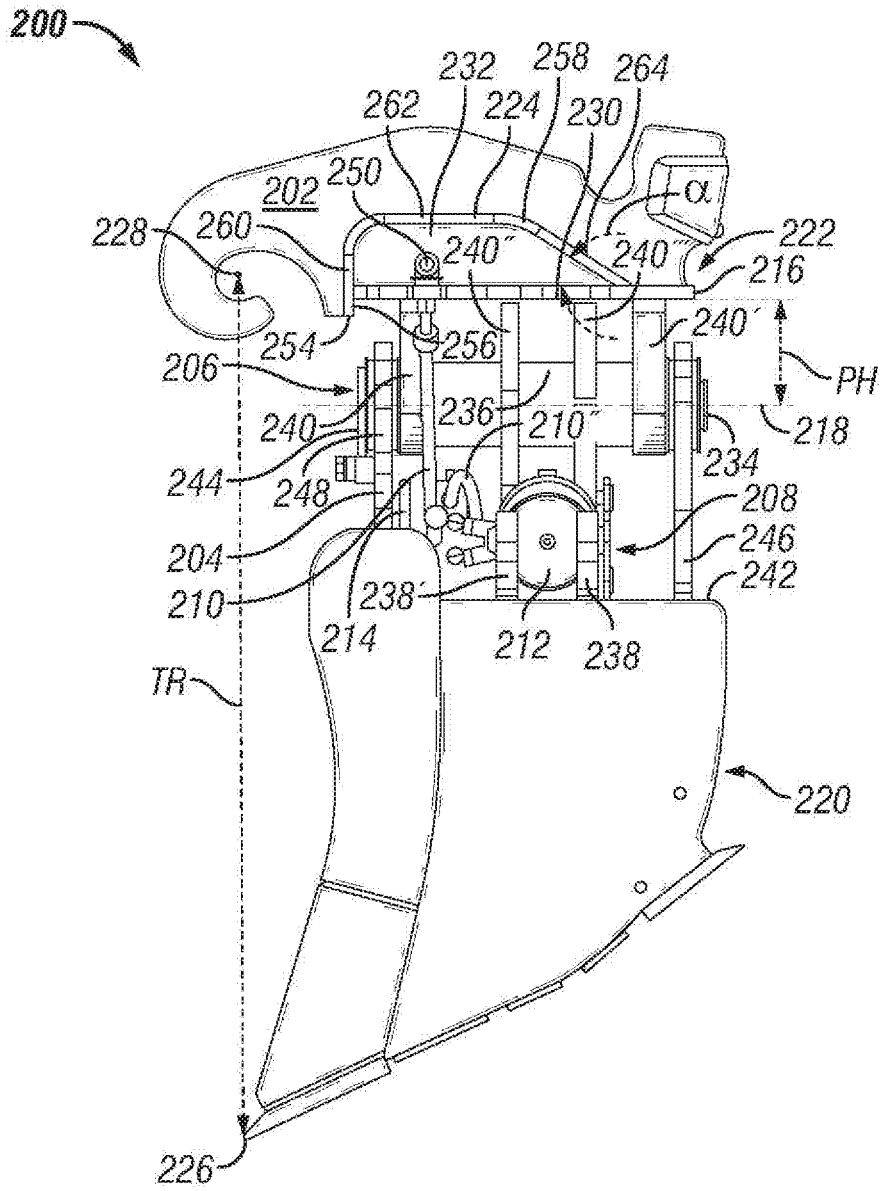
FIG. 5 is a side view of the tilting bucket assembly of FIG. 4 showing a reduced pivot height from the bottom of the base plate to the pivot axis as compared to FIG. 2.
Figure 6:
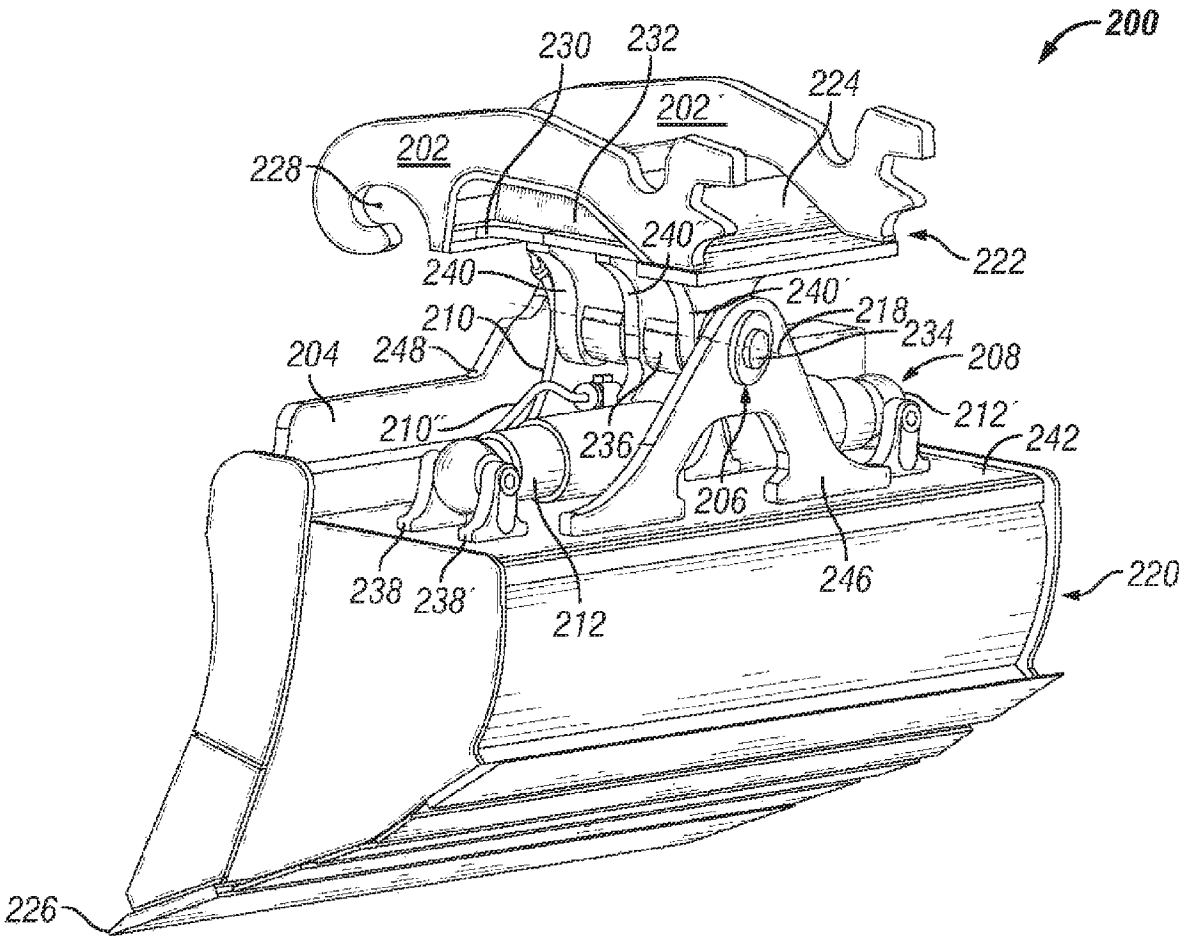
FIG. 6 is a rear perspective view of the tilting bucket assembly of FIG. 4 with slight modifications such as the backup plate is omitted and only one middle member is shown that extends down from the adapter subassembly for providing both the pivot connection and means for attaching the hydraulic cylinder of the tilting mechanism.

Referring still to FIGS. 4-6, two members 238 are provided as part of the bucket subassembly 220 in addition to the spill guard 204 and the rear pivot bracket 238 that are attached to the top plate 240 of the bucket. These members allow the tilt mechanism to function as will also be described momentarily herein. The spill guard 204 and rear pivot bracket 246 also define bores for receiving the bushing member 236 and/or the pin 234. The pin 234 may be held in the bushing member 236 using a flag plate 244 that is bolted to the spill guard 204 or retaining clips, etc. The devices and methods for providing a pivot connection may be altered as needed or desired.

As best seen in FIG. 4, the spill guard 204 lacks clearance notches (see 106 in FIG. 1) for receiving the adapter subassembly 222 and includes stop portions 248 that are configured to contact the adapter subassembly 222 as the bucket subassembly 220 is tilted by the tilting mechanism 208. As best seen in FIG. 6, this mechanism 208 includes at least one hydraulic cylinder 212 and at least one hydraulic hose 210 that are connected via the fluid coupling 250 (see FIG. 8) to the hydraulic system (not shown) of the machine. Hydraulic fluid supplied to the cylinder 212 makes the cylinder expand, causing the cylinder to push on a member 238 of the bucket subassembly 220 and on a member 240" of the adapter assembly 222 simultaneously, causing the bucket subassembly 220 to pivot about the pivot axis 218. As shown in FIG. 6, two sets of hydraulic cylinders 212, 212' and hoses 210, 210' are provided to facilitate tilting of the bucket subassembly 220 in either direction from the horizontal position of the bucket about the pivot axis 218, providing equal and opposite tilt angles of 45 degrees. When fluid is supplied to one cylinder, fluid may be withdrawn from the other cylinder so that it can contract. The tilting mechanism 208 and the angles of tilt may be varied as needed or desired. For example, the bucket subassembly 220 may be configured to tilt in only one direction. Furthermore, the bucket subassembly 220 may be divided into two parts that meet along a vertical plane (see VP in FIG. 4) taken through the pivot axis 218 and the pivot height PH and that move in opposite directions to form separate tilt angles, etc.

Referring back to FIG. 5, the adapter assembly 222 defines a pivot height PH that is the minimum distance measured from the base plate 216 to the pivot axis 218 when the pivot angle is zero degrees such as shown in FIGS. 4 and 5. As shown, this distance is measured along a vertical direction when the assembly is oriented with the front working edge 226 and base plate 216 arranged along a horizontal direction. The pivot clearance ratio, which is the ratio of the hook distance D202 to the pivot height PH, has been found by the inventors to suitably identify applications for various embodiments of the present disclosure. This ratio, for example, may range from 3 to 6.

Figure 7:
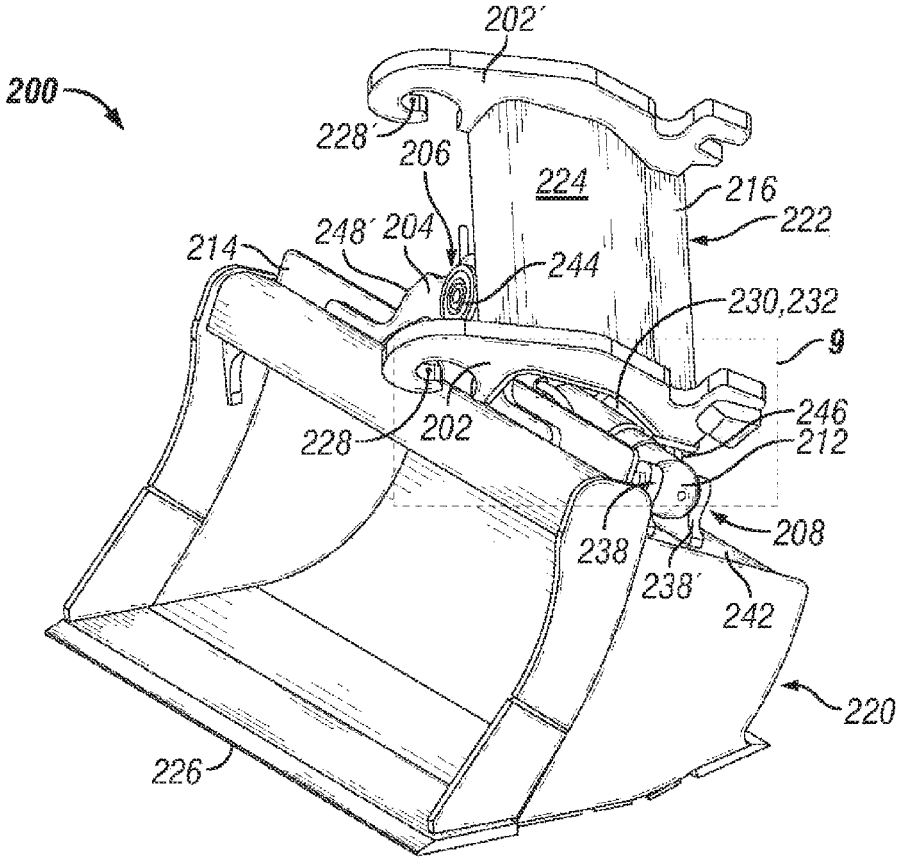
FIG. 7 is a front perspective view of the tilting bucket assembly of FIG. 4, showing the bucket subassembly tilted at a 45 degree angle without needing a V-shaped notch due to the recessed pivot design that is provided.

In such applications, it is desirable to provide features that allow the tilt angle of 45 degrees to be achieved without requiring the spill guard 204 to be configured with clearance notches for receiving the base plate 216 or another portion of the adapter subassembly 222. For example as best seen in FIGS. 7 thru 9, the first recess 230 and second recess 232 may be configured to clear the spill guard 204, the hydraulic cylinder 212, and the hydraulic hose 210 when the base plate 216 contacts a stop portion 248 of the spill guard 204.

Figure 10:
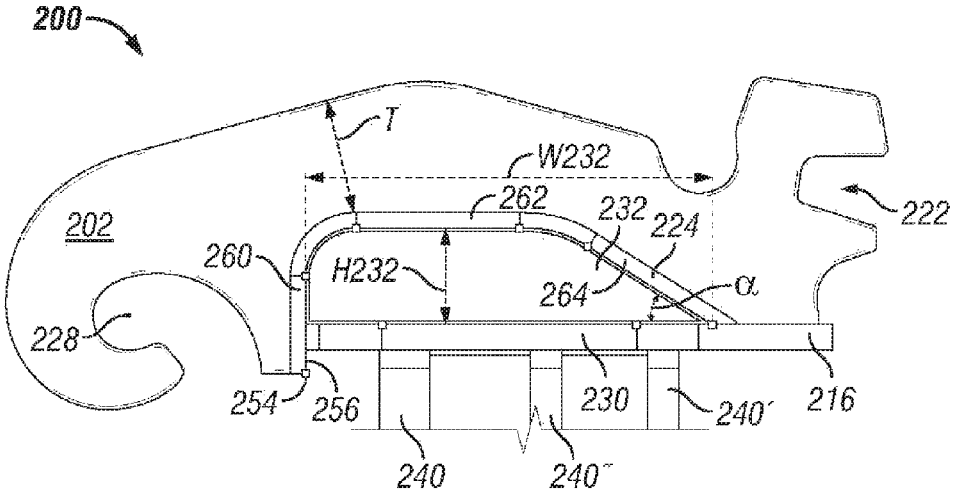
FIG. 10 is an enlarged detail view of the tilt bucket assembly of FIG. 5, showing the dimensions of the recess formed by the torsion tube and the base plate.

Looking now at FIG. 10, the second recess 232 of the torsion tube 224 defines a maximum width W232 parallel to the pivot axis 218 that ranges from 300 to 800 mm and a maximum height H232 perpendicular to the pivot axis 218 and parallel with the pivot height PH that ranges from 60 to 200 mm. It should be noted that these ranges vary greatly depending on the size of the bucket in question. In particular embodiments, the maximum width of the second recess may vary from 300 to 800 mm while the maximum height may vary from 60 to 200 mm. As also shown in FIG. 10, the minimum thickness T from the top surface of a hook member 202 to the second recess 232 of the torsion tube 224 may range from 75 to 150 mm in some embodiments.

Figure 11:
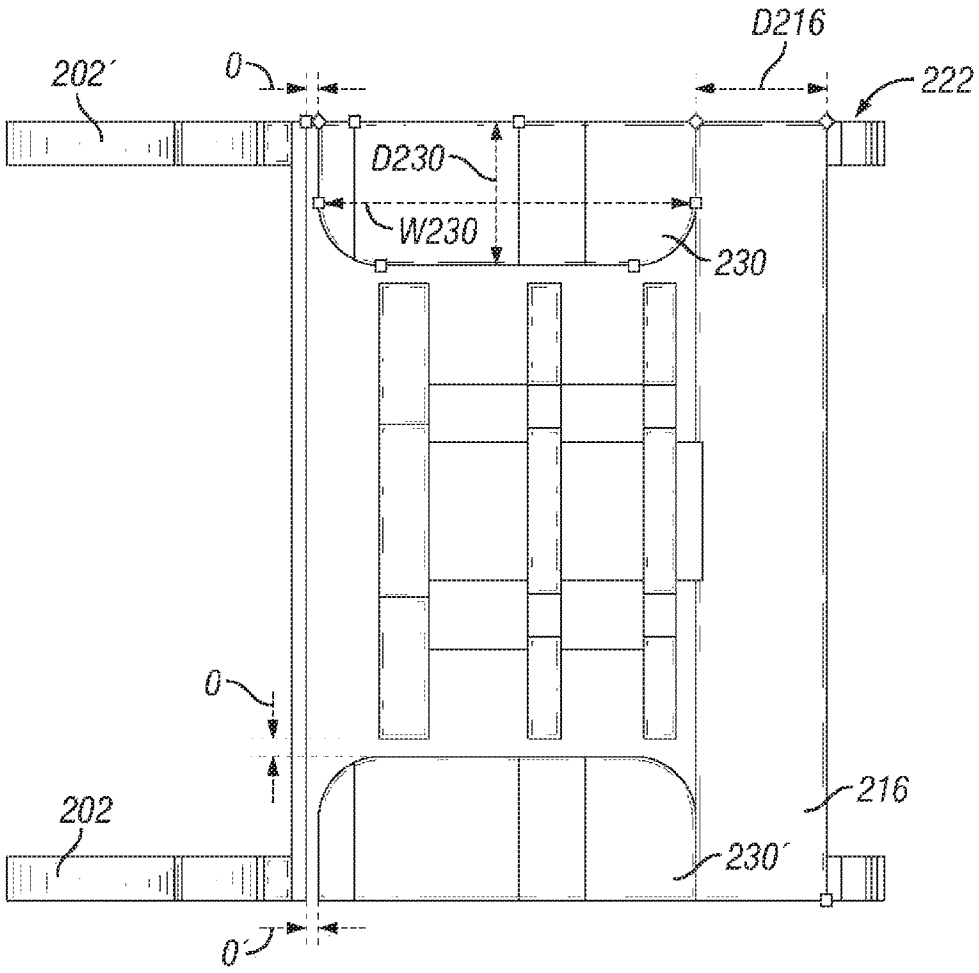
FIG. 11 is a bottom view of the tilt bucket assembly of FIG. 4, illustrating the cutout dimensions of the recess of the base plate.

Similarly, FIG. 11 illustrates that the first recess 230 defines a maximum width W230 parallel to the pivot axis that ranges from 250 to 750 mm and maximum depth D230 perpendicular to the pivot axis 218 and parallel with the spill guard 204 that ranges from 100 to 400 mm. In particular embodiments, the width of the first recess 230 may vary from 250 to 750 mm and the maximum depth may vary from 100 to 400 mm. The amount O the second recess 232 is greater in terms of both depth and width as compared to those dimensions of the first recess 230 may vary but in particular embodiments this distance may range from 5 to 50 mm. The distance D216 that the torsion base plate extends past the torsion tube toward the rear of the assembly may also be optimized. It is contemplated that this distance may range from 90-200 mm in some embodiments.

Figure 8:
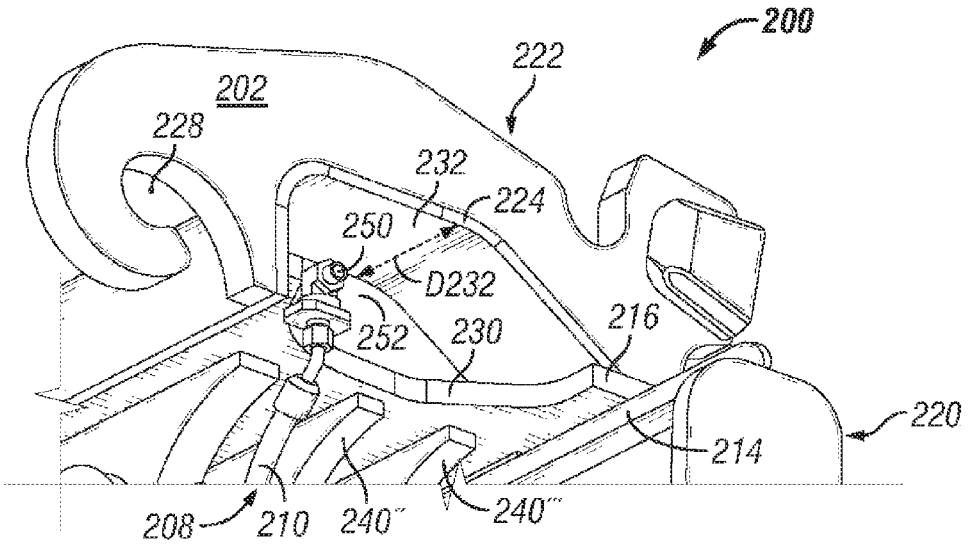
FIG. 8 is an enlarged perspective view of the bucket assembly of FIG. 4, showing the recesses formed by the base plate and the torsion tube with the assembly at a zero degree tilt.
Figure 9:
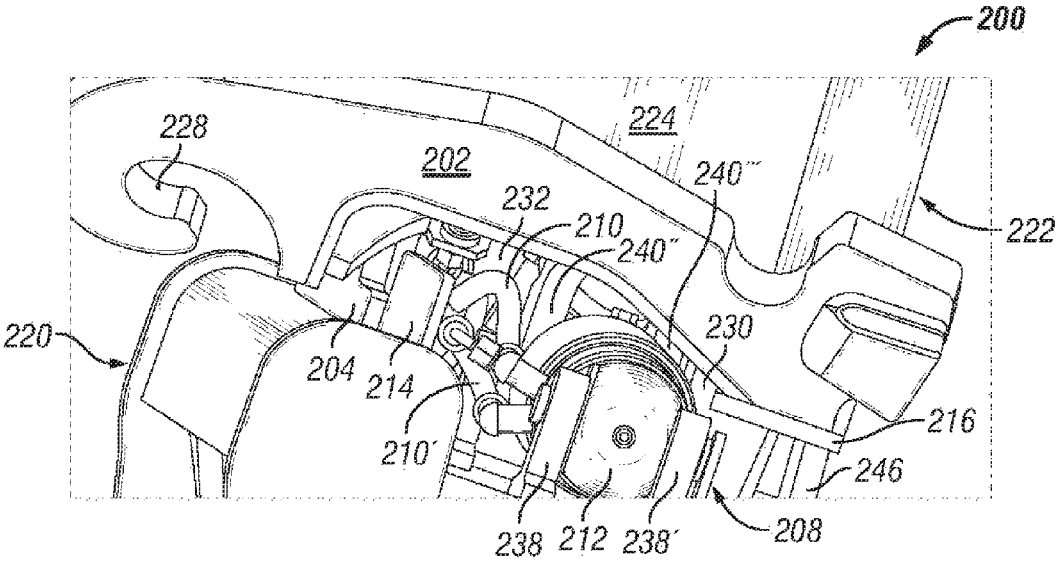
FIG. 9 is an enlarged detail view of tilt bucket assembly of FIG. 7, showing more clearly how the recesses formed by the base plate and the torsion tube allow a 45 degree tilt.

Looking back at FIG. 8, in some embodiments the second recess 232 may define a depth D232 parallel to the depth of the first recess 230, wherein the depth of the second recess 232 is greater than the depth D230 of the first recess 230 and the width W232 of the second recess 232 is greater than the width W230 of the first recess 230. In further embodiments as also depicted by FIG. 8, the torsion tube 224 may include a bottom plate 252 that is connected to the torsion tube 224 and the base plate 216, defining the depth D232 of the second recess 232. This plate may be useful in preventing water, dirt, debris and the like from entering between the torsion tube and the base plate, collecting in this void. This feature may be omitted in other embodiments.

FIGS. 5 and 10 show that the torsion tube 224 may include a side portion 254 that extends past the base plate 216 along a direction that is substantially parallel with the pivot height PH. This provides a right angle intersection 256 between the base plate 216 and the torsion tube 224, allowing a strong weld to be formed between the torsion tube 224 and the base plate 216 along the horizontal seam between these components. This feature may be omitted in other embodiments.

It should be noted that any of the embodiments described herein may be substantially symmetrical about a vertical plane VP (see FIG. 4) defined by the pivot axis 218 and the pivot height PH such as when the tilt angle is at zero degrees. This may not be the case for other embodiments.

In other embodiments, the pivot clearance ratio may not be important while providing clearance between the adapter subassembly and the spill guard and the tilting mechanism may be important. Referring again to FIGS. 4-11, such a tilting bucket assembly 200 may comprise an adapter subassembly 222 that includes a hook distance D202 between a pair of hook members 202, which is the minimum distance between the hook members 202. The adapter subassembly 222 may further include a base plate 216 attached to the hook members 202 and that defines a first recess 230, a torsion tube 224 that defines a second recess 232 that is in communication with the first recess 230. The first recess 230 and second recess 232 are configured to clear the spill guard 204, the hydraulic cylinder 212, and the hydraulic hose 210 when the base plate 216 contacts a stop portion 248 of the spill guard 204.

As mentioned previously, a pivot clearance ratio may be defined as the hook distance D202 divided by the pivot height PH. While these embodiments are not limited to any particular pivot clearance ratios, it is contemplated that this pivot clearance ratio may range from 3 to 6 for some of these embodiments.

Focusing now on FIGS. 5 and 10, the torsion tube 224 defines a perimeter 258 in a plane VP defined by the pivot height PH and the pivot axis 218. This perimeter 258 essentially surrounds the second recess 232 and includes a straight portion 260 that is substantially parallel to the pivot height PH that leads to a straight segment 262 that is parallel to the pivot axis 218 that transitions to an angled portion 264 that forms an included angle $\alpha$ with the pivot axis. This angle $\alpha$ may vary as needed or desired by may range from 25 to 45 degrees in certain embodiments. As best seen in FIGS. 7-9, the straight vertical portion 260 allows the second recess 232 to avoid hitting the spill guard 204 and the backup plate 214 when a full 45 degree tilt is effectuated. More specifically, the backup plate 214 is disposed behind the spill guard 204 and the first and second recesses 230, 232 are configured to clear the backup plate 214 when the base plate 216 contacts a stop portion 248 of the spill guard 204.

It is contemplated that in most embodiments, the spill guard 204 lacks clearance notches for receiving the adapter subassembly. However, it is further contemplated that spill guards 104 with clearance notches 106 (see FIG. 1) may be provided in special applications such as when a tilt angle of more than 45 degrees may be needed or when a single spill guard is meant to accommodate tilt bucket designs of various configurations necessitating extra features, etc.

In yet further embodiments, the shape of the recesses 230, 232 of the torsion tube 224 or base plate 216 may be more important than the pivot clearance ratio or whether the recesses 230, 232 are configured to avoid hitting the spill guard 204. For example, the shapes of these recesses may be optimized to provide the required strength for adapter subassembly. In such embodiments as shown by FIGS. 4 thru 11, a tilting bucket assembly 200 may comprise an adapter subassembly 222 including a pair of hook members 202 that define a hook distance D202 between them. A base plate 216 may be attached to the hook members 202 that defines a first recess 230 while a torsion tube 224 that defines a second recess 232 may be in communication with the first recess 230. A bucket subassembly 220 may be pivotally connected to the adapter subassembly 222 defining a pivot axis 218. The bucket subassembly includes a spill guard 204 including stop portions 248 that are configured to contact the adapter subassembly 222 when tilting of the bucket subassembly 220 is effectuated. A tilting mechanism 208 may be provided that includes at least one hydraulic cylinder 212 and at least one hydraulic hose 210 and a coupling 250 for providing fluid to the hydraulic cylinder 212 and the hydraulic hose 210.

As best seen in FIG. 5, the adapter assembly 222 may define a pivot height PH that is the minimum distance measured from the base plate 216 to the pivot axis 218 and the torsion tube 224 may define a perimeter 258 in a plane VP (shown in FIG. 4) defined by the pivot height PH and the pivot axis 218, the perimeter 258 including a straight portion 260 that is substantially parallel to the pivot height PH that leads to a straight segment 262 that is parallel to the pivot axis 218 that transitions to an angled portion 264 that forms an included angle $\alpha$ with the pivot axis 218.

In many such embodiments, the first recess 230 and second recess 232 are configured to clear the spill guard 204, the hydraulic cylinder 212, and the hydraulic hose 210 when the base plate 216 contacts a stop portion 248 of the spill guard 204. A backup plate 216 may also be provided that is disposed behind the spill guard 204 that is fits within the recesses 230, 232, allowing the base plate 216 to contact the spill guard 204 without needing clearance notches in the spill guard 204.

In some embodiments, the included angle $\alpha$ of the angled portion 264 may range from 25 to 45 degrees. Likewise, in some embodiments, the pivot clearance ratio of the hook distance D202 divided by the pivot height PH may range from 3 to 6. The values of the angle and pivot clearance ratio may be varied as needed or desired in other embodiments.

As also best seen in FIG. 5, a hook member 202 may define a hook center 228 and the bucket subassembly 220 may define a front edge 226. The assembly 220 may further define a tip radius TR that is the minimum distance from the hook center 228 to the front edge 226 that ranges from 1000 to 2000 mm. The assembly may also defines a break out force optimization ratio that is equal to the hook distance D202 divided by the tip radius TR. The larger the tip radius TR, the easier it is for the bucket to break through soil and the like when moving or tilting from one side to another as the lever arm from the pivot point or hook center to the front working edge is decreased, reducing the amount of force necessary to be exerted by a hydraulic cylinder to move the bucket through soil as it is tilted. It is contemplated that the break out force optimization ratio may be used in addition to or in lieu of the pivot clearance ratio in determining whether a particular application is well suited to use any of the embodiments of a tilting bucket assembly as described herein. In many cases, it is desirable to maintain the bucket capacity while increasing the pivot clearance ratio. As a natural consequence, the break out force optimization ratio may also be naturally increased.

INDUSTRIAL APPLICABILITY

In practice, a tilting bucket assembly may be sold, manufactured, bought or otherwise provided according to any of the embodiments described herein. In some applications, a bucket subassembly may be retrofitted or repaired with a tilting mechanism, spill guard and an adapter subassembly according to any of the embodiments discussed herein. The parts and/or subassemblies needed for retrofitting or repairing may be sold, manufactured, bought or otherwise provided.

Any of the tilting bucket assemblies as described herein may be attached to a work machine using a quick coupling mechanism that is now known or that will be devised in the art. Alternatively, these tilting bucket assemblies may be more permanently attached to the work machine. Accordingly, the hook members may be substituted with any coupler member that is capable of mating with a coupling mechanism of the machine, whether that mechanism is a quick coupler mechanism or not. For example, the hook apertures may be substituted with pins that mate with apertures of the coupler mechanism of the machine, etc. Consequently, the hook distance may be more generally characterized as the coupler distance and the pivot clearance ratio and break out force optimization ratio may be defined as the coupler distance divided by the pivot height or tip radius respectively.

A method for attaching the tilting bucket assembly to a machine may comprise attaching the adapter subassembly to the machine using a coupling mechanism. Then, the tilt mechanism may be placed in communication or operative association with means for activating the tilt mechanism.

In some embodiments, this may include attaching the hydraulic cylinder to the hydraulic system of the machine through a hydraulic hose of the assembly that is connected at one end to a hydraulic cylinder and to the other end by a coupler to a hydraulic hose of the machine that is in communication with the hydraulic system of the machine.

The tilting mechanism may be powered mechanically or electrically, etc. in other embodiments.

The adapter assembly may be configured to provide one or more recesses that are configured to provide clearance so that the base plate may contact the stop portion of a spill guard without contacting any portion of the tilt mechanism or another member of the bucket subassembly.

A torsion tube may be provided that is formed using a stamping die or brake pressing operation to form the perimeter of the torsion tube and a base plate may be welded or otherwise attached to the torsion tube. A bottom plate may be welded or otherwise attached to the base plate and the torsion tube. The torsion tube may extend past a hook member in both a downward vertical as well as horizontal direction. The hook member may be machined by laser, water jet, etc. to cutout a profile that is suitable for receiving the upper portion of the torsion tube. The hook member may be welded or otherwise attached to the torsion tube and base plate.

Any of the members including the spill guard, preformed sheet for the torsion tube and the base plate may be machined using any suitable process including laser, water jet, etc.

Once the tilting bucket assembly is attached to the machine, the tilting mechanism may be activated causing the bucket subassembly to pivot relative to the adapter subassembly until the base plate hits a stop portion of the spill guard. In some instances, this may be accomplished without needing clearance notches in the spill guard. The torsion tube and the base plate may be configured to allow this movement without hitting any portion of the tilt mechanism or other part of the bucket subassembly. The rear of the bucket subassembly including the rear pivot plate, such as shown by FIG. 6, may be relatively open, allowing the efficient removal of dirt and debris from around the tilt mechanism and the adapter subassembly. The pivot clearance and/or break out force optimization ratios may be increased to augment the performance of the tilting bucket assembly in a manner that has already been described herein.

The configuration of the spill guard may also be optimized to limit the exposure of hydraulic lines and other components of the tilt mechanism from dirt and debris (see FIG. 4).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A tilting bucket assembly comprising:

an adapter subassembly including a pair of coupler members that define a coupler distance which is the minimum distance therebetween;

a base plate attached to the coupler members and that defines a first recess;

a torsion tube that defines a second recess that is in communication with the first recess; and a bucket subassembly that is pivotally connected to the adapter subassembly defining a pivot axis, the bucket subassembly including a spill guard lacking clearance notches for receiving the adapter subassembly, the spill guard including at least one stop portion that is configured to contact the adapter subassembly;

and a tilting mechanism;

wherein the adapter assembly defines a pivot height that is the minimum distance measured from the base plate to the pivot axis, and wherein a pivot clearance ratio of the coupler distance to the pivot height ranges from 3 to 6.

2. The assembly of claim 1 wherein the first recess and second recess are configured to clear the spill guard and the tilting mechanism, the tilting mechanism including a hydraulic cylinder and a hydraulic hose when the base plate contacts a stop portion of the spill guard.

3. The assembly of claim 1 wherein the first recess defines a width parallel to the pivot axis that ranges from 250 to 750 mm and a depth perpendicular to the pivot axis and parallel with the spill guard that ranges from 100 to 400 mm.

4. The assembly of claim 3 wherein the second recess defines a maximum width parallel to the pivot axis that ranges from 300 to 800 mm and a maximum height perpendicular to the pivot axis and parallel with the pivot height that ranges from 60 to 200 mm.

5. The assembly of claim 4 wherein the second recess defines a depth parallel to the depth of the first recess, wherein the depth of the second recess is greater than the depth of the first recess and the width of the second recess is greater than the width of the first recess.

6. The assembly of claim 5 wherein the torsion tube includes a bottom plate that is connected to the torsion tube and the base plate, defining the depth of the second recess.

7. The assembly of claim 1 wherein the torsion tube includes a side portion that extends past the base plate along a direction that is substantially parallel with the pivot height.

8. A tilting bucket assembly comprising:

an adapter subassembly including a pair of coupler members that define a coupler distance, which is the minimum distance therebetween;

a base plate attached to the coupler members and that defines a first recess;

a torsion tube that defines a second recess that is in communication with the first recess; and a bucket subassembly that is pivotally connected to the adapter subassembly defining a pivot axis, the bucket subassembly including a spill guard including at least one stop portion that is configured to contact the adapter subassembly; and a tilting mechanism;

wherein the first recess and second recess are configured to clear the tilting mechanism and the spill guard when the base plate contacts a stop portion of the spill guard.

9. The assembly of claim 8 wherein the adapter assembly defines a pivot height that is the minimum distance measured from the base plate to the pivot axis, and wherein a pivot clearance ratio of the coupler distance to the pivot height ranges from 3 to 6.

10. The assembly of claim 9 wherein the torsion tube defines a perimeter in a plane defined by the pivot height and the pivot axis, the perimeter including a straight portion that is substantially parallel to the pivot height that leads to a straight segment that is parallel to the pivot axis that transitions to an angled portion that forms an included angle with the pivot axis.

11. The assembly of claim 8 wherein the bucket subassembly further comprises a backup plate disposed behind the spill guard and the first and second recesses are configured to clear the backup plate when the base plate contacts a stop portion of the spill guard.

12. The assembly of claim 8 wherein the spill guard lacks clearance notches for receiving the adapter subassembly.

13. A tilting bucket assembly comprising:

an adapter subassembly including a pair of coupler members that define a coupler distance therebetween;

a base plate attached to the couple members and that defines a first recess;

a torsion tube that defines a second recess that is in communication with the first recess; and a bucket subassembly that is pivotally connected to the adapter subassembly defining a pivot axis, the bucket subassembly including a spill guard including at least one stop portion that is configured to contact the adapter subassembly; and a tilting mechanism;

wherein the adapter assembly defines a pivot height that is the minimum distance measured from the base plate to the pivot axis and the torsion tube defines a perimeter in a plane defined by the pivot height and the pivot axis, the perimeter including a straight portion that is substantially parallel to the pivot height that leads to a straight segment that is parallel to the pivot axis that transitions to an angled portion that forms an included angle with the pivot axis.

14. The assembly of claim 13 wherein the first recess and second recess are configured to clear the tilting mechanism when the base plate contacts a stop portion of the spill guard.

15. The assembly of claim 13 wherein the included angle ranges from 25 to 45 degrees.

16. The assembly of claim 13 wherein a pivot clearance ratio of the coupler distance to the pivot height ranges from 3 to 6.

17. The assembly of claim 14 wherein the bucket subassembly further comprises a backup plate disposed behind the spill guard and the first and second recesses are configured to clear the backup plate when the base plate contacts a stop portion of the spill guard.

18. The assembly of claim 13 wherein the spill guard lacks clearance notches for receiving the adapter subassembly.

19. The assembly of claim 13 wherein a coupler member defines a coupler center, the bucket subassembly defines a front edge, and the assembly further defines a tip radius that is the minimum distance from the coupler center to the front edge that ranges from 1000 to 2000 mm.

20. The assembly of claim 14 wherein the assembly is configured to tilt to an angle of 45 degrees.

* * * * *